United States Patent [19]

Nudelman et al.

[11] 4,155,705

[45] May 22, 1979

[54] DEVICE FOR HEAT TREATMENT OF FREE-FLOWING MATERIALS

[76] Inventors: Boris I. Nudelman, Chilanzar, kvartal 8, 27, kv. 48; Vakel K. Imangulov, Chilanzar, 1 proezd Sun-Yat-Sena, 2; Vitaly I. Lisbaron, Chilanzar, kvartal 6, 2, kv. 9; Ida T. Uvarova-Nistratova, ulitsa Vrevskaya, proezd 2, 11; Ljudmila N. Krugovykh, ulitsa B. Khmelnitskogo, 61, kv. 32; Albert P. Simon, ulitsa Taneeva, 33, kv. 29; Grigory S. Shteinberg, ulitsa B. Khmelnitskogo, 9, korpus 5, kv. 6; Boris A. Perlin, Khamzinsky raion, ulitsa Koldirgach, 5; Jury A. Logvinenko, ulitsa Samarkandskaya, 38, korpus 12, kv. 8, all of Tashkent, U.S.S.R.

[21] Appl. No.: 792,912

[22] Filed: May 2, 1977

[51] Int. Cl.[2] ..... F27B 7/02

[52] U.S. Cl. ..... 432/106; 432/95

[58] Field of Search ..... 432/95, 101, 106, 99; 241/17, 198 A, DIG. 13

[56] References Cited

U.S. PATENT DOCUMENTS

| | | | |
|---|---|---|---|
| 501,494 | 7/1893 | Davis, Jr. | 432/99 |
| 999,492 | 8/1911 | Ellis | 432/106 |
| 1,895,284 | 1/1933 | Hay | 432/99 |
| 3,063,647 | 11/1962 | Lellep | 241/17 X |
| 3,284,075 | 11/1966 | Azbe | 432/106 |
| 4,059,396 | 11/1977 | Dan | 432/106 |

*Primary Examiner*—John J. Camby

[57] ABSTRACT

Apparatus for treatment and making of construction materials and the like having a rotary kiln. Calcined material from the rotary kiln is reduced in size by driven rolls and delivered as free-flowing material at an upper end region to a vertical shaft kiln having peripheral walls inclined from the vertical no more than 3° and diverging downwardly. A sidewall of the shaft kiln has perforations inclined downwardly for flow of hot gases into the shaft kiln in the general direction of flow of material downwardly in said shaft kiln. The treated material from the shaft kiln is discharged from a lower end region and transported therefrom by a grate system having heaters for heating the treated material thereon.

4 Claims, 4 Drawing Figures

DEVICE FOR HEAT TREATMENT OF FREE-FLOWING MATERIALS

BACKGROUND OF THE INVENTION

The present invention relates to equipment for the manufacture of construction materials and more particularly it relates to devices for heat-treatment of free-flowing materials.

For example, the device can be utilized for removal of chlorides from cement clinker when the latter is being calcinated with chlorine-containing compounds, and for its subsequent cooling.

A rotary shaft kiln is known for calcination of small-lump materials, e.g. strong ceramic pellets comprising low-temperature and high-temperature chambers with gas-permeable walls made in the form of inclined shutters, and an inclined bottom.

The formed pellets enter the low-temperature calcination chamber wherein they are heated in the lower part of the chamber by the heat transferred from the combustion products discharged from the furnace and penetrating through the shutter walls, whereupon the calcined pellets enter the high-temperature calcination chamber. From here the finally-calcined pellets fall on a movable horizontal conveying grate where they are cooled and transferred for storage.

A disadvantage of the shaft kiln for calcination of small-lump material lies in that it has no means for disintegrating the material to the required granulometric composition, and in that there is a risk of hanging-up of the material. Moreover, the device fails to provide uniform distribution of the combustion products over the entire height of the shaft and cannot remove chlorides from the material which impairs the quality of the product.

SUMMARY OF THE INVENTION

A main object of the invention resides in providing a device for heat-treatment of free-flowing materials characterized by a certain granulometric composition.

Another object of the invention resides in improving the quality of the product.

And still another object of the invention is a maximum removal of chlorides from the material being treated.

These and other objects of the invention are accomplished by providing a device for heat treatment of free-flowing materials comprising a rotary kiln from which the material flows into a shaft located after the kiln and comprising perforated walls and a chamber for the distribution of hot gases. The chamber adjoining one of the walls. The material is discharged through a movable horizontal grate wherein, according to the invention, material-crushing rolls are installed between the rotary kiln and the shaft, the perforated walls of the shaft are inclined at a certain angle to each other so that the shaft flares out towards the bottom and wherein the distributing chamber consists of at least two sections.

Such a construction of the device ensures its stable operation with a certain output and rules out the hanging-up of the materials inside the shaft.

It is practicable that the inclination angle of the shaft should vary from 1° to 3° which would be sufficient for preventing the hanging-up of the flowing material.

It is expedient that the movable grate should be made up of individual bars, each provided with burners to ensure final removal of chlorides throughout the area of the grate where heat treatment is being conducted.

It is likewise practicable that the inclination angle of the burner nozzles to the bar surface in the direction of material flow should be from 3° to 90° which would rule out penetration of small lumps of material into the burner orifices and would allow a certain increase in the thickness of the layer of material.

The essence of the invention resides in the following. The material that has been calcinated in the rotary kiln and contains chlorides enters the rolls installed under the discharge end of the kiln, and is crushed to the required size. Then it flows into a vertical shaft with inclined perforated walls. Inclination of the walls ensures free flow of the material through the shaft, without hanging up. The preferable inclination angle of the perforated walls ranges from 1° to 3°. A larger angle will bring about additional structural and technological difficulties. From the shaft the material is conveyed by known means onto a movable heating grate where it is subjected to additional heat treatment with a steam-gas-air mixture delivered under the layer of the material through the burners installed in the grate bars. These burners are installed in the grate bars so that they are located only in the front part of the grate, preferably at a distance of 0.2–0.5 of its length. The inclination angle of the burner nozzles to the surface of the grate bars in the direction of material flow should range from 3° to 90° which prevents penetration of the material into the burner nozzles, allows the temperature of the grate bars to be maintained below the temperature of the material under treatment and makes it possible to vary the thickness of the material layer. Such a construction of the device allows the material to be fully heat-treated at a maximum efficiency of said device.

BRIEF DESCRIPTION OF THE DRAWINGS

The invention will be made more apparent by the appended drawings showing an example of the device for heat treatment of free flowing materials according to the invention, in which.

DESCRIPTION OF THE PREFERRED EMBODIMENTS

Figures 1, 2, 3, 4:
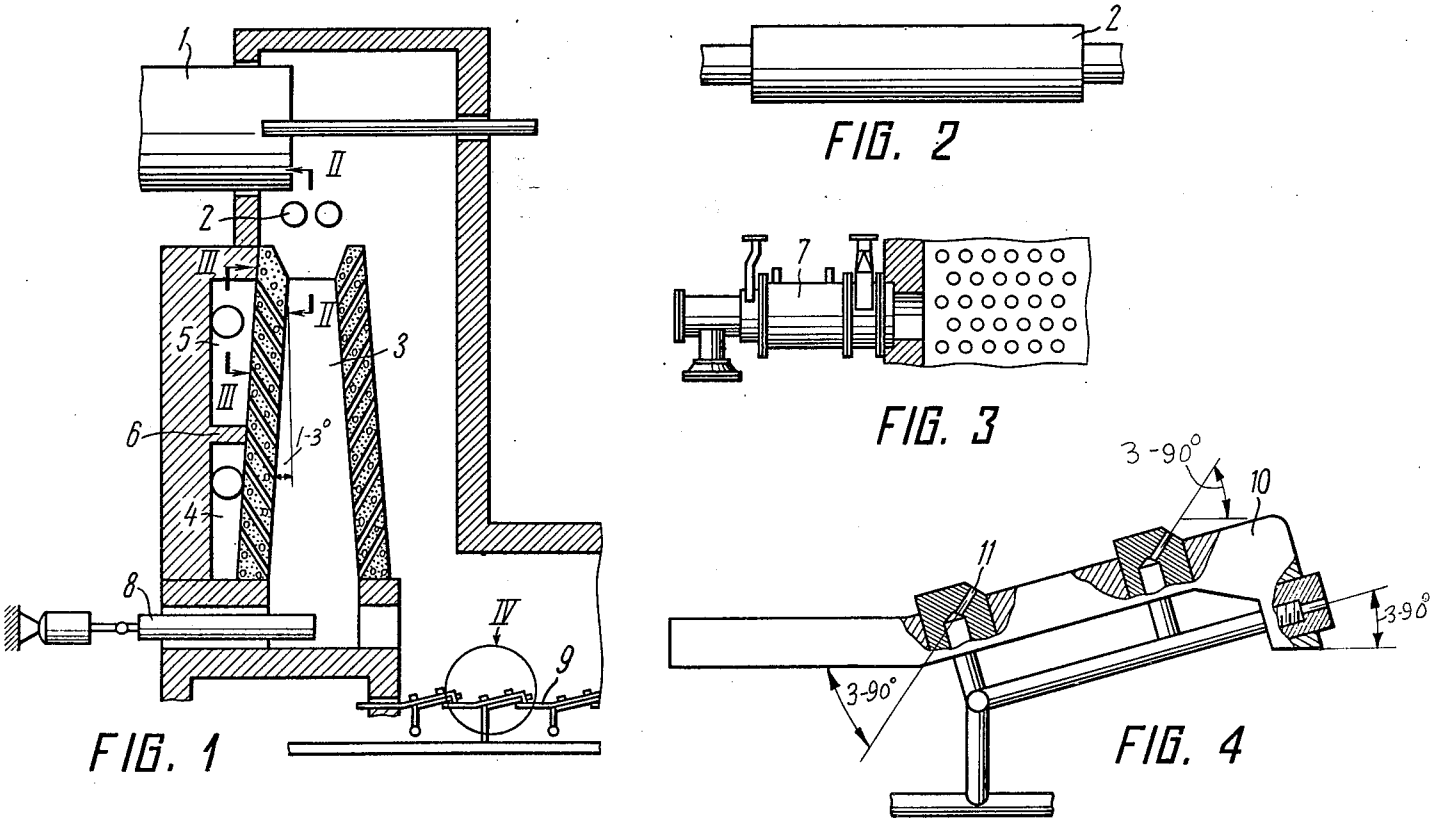
FIG. 1 is a schematic general view of the device for heat treatment of free-flowing materials.
FIG. 2 is a section view taken along section line II—II in FIG. 1.
FIG. 3 is a section view taken along section line III—III in FIG. 1.
FIG. 4 is an fragment elevation view of a IV in FIG. 1 on an enlarged scale.

The device illustrated in the drawings (FIGS. 1 through 4) comprises a rotary kiln 1 for calcination of free-flowing materials containing chlorides. Installed at the discharge end of the kiln 1 are rolls 2 mounted on supporting bearings (not shown in the drawings) and provided with an independent drive (not shown in the drawing). The rolls are intended to crush the material to the required granulometric composition. Installed directly under the rolls 2 is a vertical shaft 3 consisting of two perforated walls inclined to each other at an angle varying from 1° to 3°. Each wall of the shaft has round holes distributed over the entire surface of the wall. The clear opening through the holes is from 20 to 25% of the shaft wall area. The holes are inclined in the direction of material flow so as to prevent said material from falling out of the shaft. One of the walls of the shaft 3 adjoins a distributing chamber consisting of sections 4 and 5 separated by a partition 6. The distributing chamber is intended to build up uniform pressure of the gas combustion products throughout the height of the shaft 3 and can be installed either outside or inside the shaft. The number of sections of the distributing chamber depends on the size of the shaft 3. Each section of the distributing chamber adjoins a furnace 7 whose function is to burn the fuel and deliver a steam-gas-air mixture into the distributing chamber. The construction of the furnace may be of any known type. Located in the lower part of the shaft 3 is a means 8 for conveying the material from the shaft 3 onto a movable horizontal grate 9. The means 8 can be made in the form of, say, a pusher or a conveyor. Besides, a version can be contemplated when the grate 9 is located directly under the shaft 3. The movable grate 9 is made up of individual bars 10, each provided with a built-in burner 11 for additional heat treatment of the material by delivering a steam-gas-air mixture under the layer of said material. The grate bars with burners are spaced along the material flow at intervals equal to 0.2–0.5 of the grate length. The nozzles of the burners 11 are inclined to the surface of the bars at 3° to 90°.

The device according to the invention functions as follows.

The material that has been calcinated in the rotary kiln 3 enters into the rolls 2 where it is crushed to a granulometric composition required for heat treatment and is delivered into the shaft 3 with perforated walls. The products of combustion produced in the furnace 7 flow into the upper 5 and lower 4 sections of the distributing chamber wherefrom they pass uniformly through the holes in the walls of the shaft 3 into the layer of material contained in the shaft. Thus, the material is heat treated and freed of chlorides. Then the treated material is delivered by the conveying means 8 onto the movable grate 9 where it is finally heat treated with a steam-gas-air mixture supplied through the burners 11 built into the bars 10. The completely processed material is delivered for cooling.

Another method is possible in which the entire process of heat treatment of the material is completed in the shaft 3; in this case the supply of gas to the burners 11 is cut off, so that the air is delivered only for cooling the material.

Such a design of the installation allows it to be used for heat-treatment of free-flowing materials containing chlorides, said materials being calcinated in a rotary kiln.

It can be seen from the description above that the device according to the invention ensures stability of heat treatment, stable operating conditions and the requisite efficiency.

What we claim is:

1. Apparatus for treatment and making of construction materials and the like comprising, a rotary kiln, driven crushing rolls for crushing material discharged from said kiln and converting it to a free-flowing material, an upstanding shaft kiln having an open upper end for receiving crushed material directly from said rolls, said shaft kiln having peripheral walls inclined from the vertical and diverging downwardly, one sidewall of said shaft kiln having perforations disposed axially spaced along the height direction of the shaft kiln for allowing hot gases to enter the shaft kiln for treatment of the crushed material therein, and a movable grate for removing treated material discharged from adjacent a lower end region of said shaft kiln.

2. Apparatus according to claim 1, in which said grate includes means for heating said material transported thereon.

3. Apparatus according to claim 1, in which said inclined walls are inclined no more than about 3° from the vertical.

4. Apparatus according to claim 1, in which the perforations extend in a downward direction for allowing gas flows in a direction corresponding to a direction of downward movement of the crushed material in said shaft kiln.

* * * * *